United States Patent [19]

Bennett

[11] 3,942,481

[45] Mar. 9, 1976

[54] BLOWDOWN ARRANGEMENT

[75] Inventor: Robert R. Bennett, Tampa, Fla.

[73] Assignee: Westinghouse Electric Corporation, Pittsburgh, Pa.

[22] Filed: Sept. 18, 1974

[21] Appl. No.: 507,162

[52] U.S. Cl. ..... 122/32; 122/382; 122/383

[51] Int. Cl.[2] ..... F22B 1/06; F22B 37/54

[58] Field of Search ..... 122/32, 33, 34, 382, 383

[56] References Cited

UNITED STATES PATENTS

| | | | |
|---|---|---|---|
| 3,139,070 | 6/1964 | Sprague et al. | 122/34 |
| 3,635,287 | 1/1972 | Sprague | 122/32 |
| 3,811,498 | 5/1974 | Ferraro et al. | 122/32 |

*Primary Examiner*—Kenneth W. Sprague
*Attorney, Agent, or Firm*—F. J. Baehr, Jr.

[57] ABSTRACT

A steam generator having a U-shaped tube bundle which extends upwardly from a tube sheet, a wrapper encircling the tube bundle, a preheater disposed on the cold leg portion of the tube bundle and a distribution plate disposed adjacent the tube sheet, the distribution plate having a large semicircular shaped opening disposed in the central portion of the hot leg and a T-shaped blowdown pipe disposed so that the cross of the "T" is disposed adjacent the tube sheet and the central portion of the semicircular opening in the distribution plate.

4 Claims, 3 Drawing Figures

BLOWDOWN ARRANGEMENT

BACKGROUND OF THE INVENTION

This invention relates to steam generators for nuclear power plants and more particularly to a steam generator having a blowdown pipe disposed in the central portion of the hot leg adjacent the tube sheet.

Steam generators having U-shaped tube bundles and preheaters have experienced failures in the tubes adjacent the tube sheet due to the buildup of solids which form a sludge that enhances the possibility of tube leakage.

SUMMARY OF THE INVENTION

In general a vapor generator which utilizes a primary fluid to vaporize a secondary fluid, when made in accordance with this invention, comprises a vertical shell portion, a tube sheet disposed adjacent one end of the shell, a tube bundle formed by a plurality of U-shaped tubes through which the primary fluid flows to form a hot leg portion and a cold leg portion, a wrapper encircling the tube bundle and forming an annular chamber between the wrapper and the shell, and a flow distribution plate adjacent the tube sheet. The flow distribution plate has a large opening which accommodates a plurality of tubes and is centrally disposed with respect to the hot leg portion of the tube bundle. A blowdown tube is disposed between the tube sheet and the distribution plate and generally traverses the large opening and has a plurality of apertures disposed to remove secondary fluid from an area adjacent the tube sheet and the large opening.

BRIEF DESCRIPTION OF THE DRAWINGS

The objects and advantages of this invention will become more apparent from reading the following detailed description in connectionn with the accompanying drawings, in which corresponding reference characters indicate corresponding portions throughout the drawings, and in which.

DESCRIPTION OF THE PREFERRED EMBODIMENT

Figure 1:
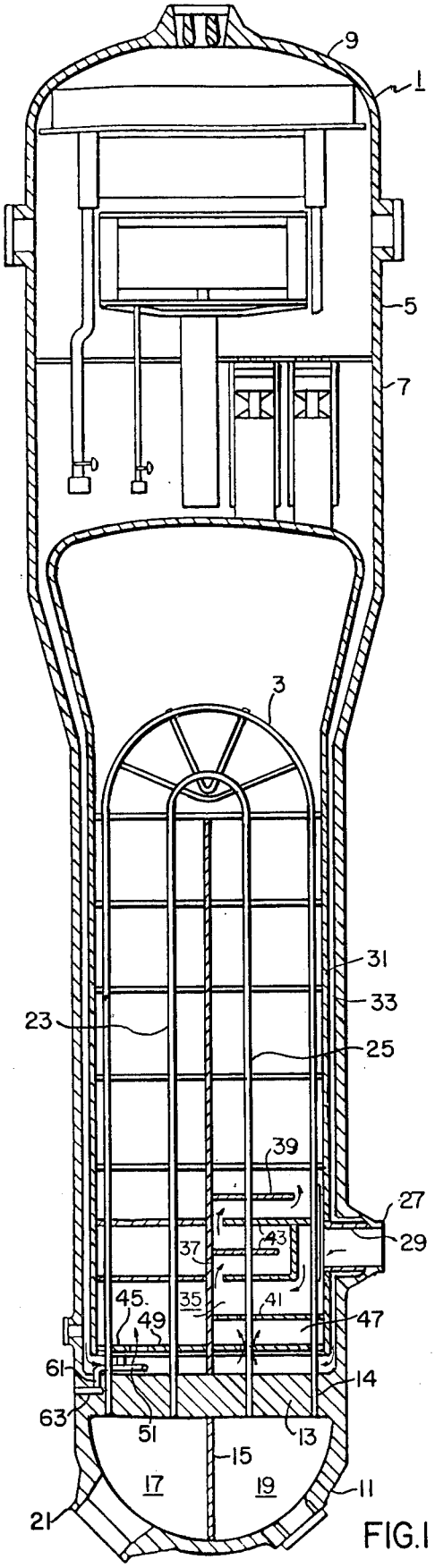
FIG. 1 is a partial sectional view of a steam generator made in accordance with this invention.
Figure 2:
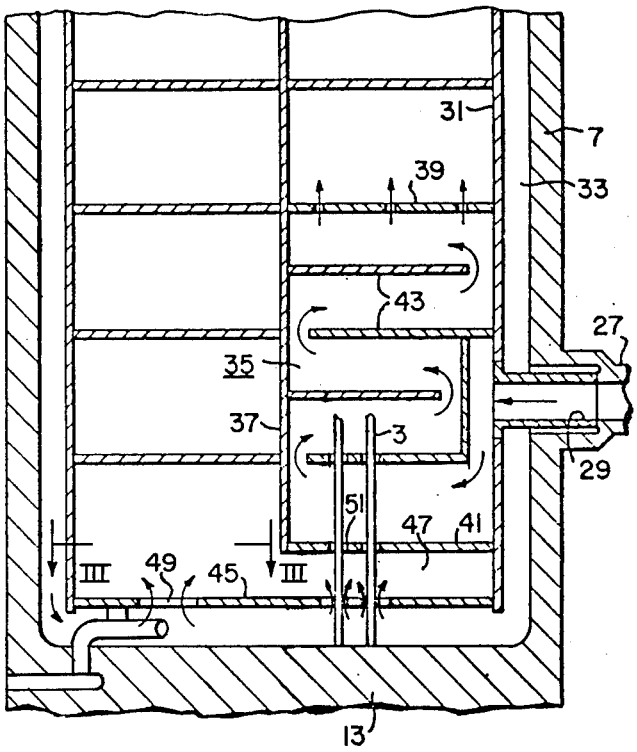
FIG. 2 is an enlarged partial sectional view showing the distribution plate and blowdown tube in detail.

Referring now to the drawings in detail, FIG. 1 shows a steam generator 1, which utilizes a U-shaped bundle of tubes 3 to provide the heating surface required to transfer heat from a primary fluid to vaporize or boil a secondary fluid. The steam generator 1 comprises a vessel 5 having a vertically oriented tubular shell portion 7 and an end closure or flanged and dished head 9 enclosing one end of the shell 7, the upper end, and a spherical shaped channel head 11 enclosing the other end of the shell 7, the lower end. A tube sheet 13 is made integral with the channel head 11 and has a plurality of holes 14 disposed therein to receive the end of the U-shaped tubes 3. A dividing plate 15 is centrally disposed in the channel head 11 to divide the channel head into two compartments 17 and 19, which serve as headers on the tubes 3. The compartment on the left, as shown in FIG. 1, is the primary fluid inlet compartment

17 and has a primary fluid inlet nozzle 21 in fluid communication therewith. The compartment on the right, as shown in FIG. 1, is the primary fluid outlet compartment 19 and has a primary fluid outlet nozzle (not shown) in fluid communication therewith, thus causing the primary inlet fluid to flow through the tubes, thereby creating a hot leg portion 23, the portion shown on the left in the drawings, and a cold leg portion 25, the portion shown on the right in the drawings. A secondary fluid or feed water inlet nozzle 27 is disposed in the lower portion of the shell 7 adjacent the tube sheet 13 and has a thermal sleeve 29 disposed therein.

The tube bundle 3 is encircled by a wrapper 31, which enclosed the tube bundle and forms an annular chamber 33 between the wrapper 31 and the shell 7.

A preheater 34 is disposed within the lower portion of the shell 7 adjacent the tube sheet 13. The preheater 35 is disposed to enclose at least a portion of the cold leg portion 25 of the tube bundle 3 and incorporates a portion of the wrapper 31, a vertical closure plate 37, a top end closure plate 39 and a lower end closure plate 41, which cooperate with the enclosed portion of the cold leg to form the preheater 35. Baffles 43 are disposed within the preheater 35 to cause the secondary fluid to follow a sinuous path therethrough. A flow distribution plate 45 is disposed between the enclosure plate 41 and the tube sheet 13 the flow distribution plate 45 extends generally across the lower end of the steam generator and cooperates with the enclosure 41 and the wrapper 31 to form a buffer zone 47 adjacent the preheater 35.

Figure 3:
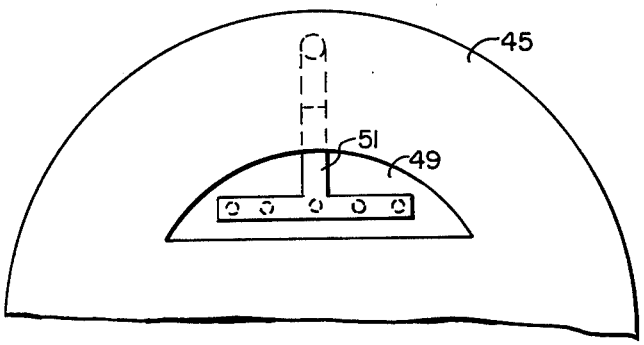
FIG. 3 is an enlarged partial sectional view taken on line III—III of FIG. 2.

As shown in FIG. 3 the flow distribution plate 45 has a large opening 49 accommodating or surrounding a plurality of tubes 3 and disposed adjacent the central portion of the hot leg portion 23 of the tube bundle. A T-shaped blowdown tube 51 is disposed between the tube sheet 13 and the distribution plate 45. The T-shaped blowdown tube 51 is formed from a stem portion 53 and a cross portion 55. The cross portion 55 transverse the central portion of the large opening 49 in the flow distribution plate 45 and has a plurality of apertures 57 disposed on the lower side thereof or adjacent the tube sheet 13 in order to remove secondary fluid from adjacent the tube sheet 13.

A baffle or flow restrictor 59 is disposed between the stem 53 of the blowdown tube 51 and the flow distribution plate 45 and is adjacent the opening 49 in order to prevent channeling of the fluid to the opening 49. The blowdown tube 51 is in communication with a drilled hole 61 extending downwardly into the tube sheet and a lateral hole 63 entering the tube sheet from the side of the steam generator to advantageously provide access to the blowdown tube without going through the shell 7 or head 11, thereby eliminating the need for reinforcing or performing stress calculations on the shell 7 and head 11.

What is claimed is:

1. A vapor generator which utilizes a primary fluid to vaporize a secondary fluid, said vapor generator comprising a vertical shell portion, a tube sheet disposed adjacent one end of said shell, a tube bundle formed by a plurality of U-shaped tubes through which the primary fluid flows to form a hot leg portion and a cold leg portion, a wrapper encircling said tubes and forming an annular chamber between said wrapper and said shell, a flow distribution plate adjacent said tube sheet, said flow distribution plate having a large opening containing a plurality of tubes, said large opening being centrally disposed with respect to said hot leg portion of said tube bundle, and a blowdown tube disposed between said tube sheet and said distribution plate and generally traversing said large opening, said blowdown tube having a plurality of apertures disposed to remove secondary fluid from an area adjacent said tube sheet.

2. A vapor generator as set forth in claim 1, wherein the blowdown tube is generally T-shaped and has a stem portion and a cross portion, the apertures being disposed in the cross portion thereof.

3. A vapor generator as set forth in claim 2 and further comprising a baffle extending between the stem portion of the blowdown tube and the distribution plate, the baffle also being disposed adjacent the large opening in the distribution plate.

4. A steam generator as set forth in claim 3, wherein the tube sheet has a passageway in communication with the outer periphery thereof and with the blowdown tube.

* * * * *